US008516778B1

(12) United States Patent
Wilkens

(10) Patent No.: US 8,516,778 B1
(45) Date of Patent: Aug. 27, 2013

(54) INSULATED WALL STUD SYSTEM

(76) Inventor: Lester B. Wilkens, Crookston, MN (US)

( * ) Notice: Subject to any disclaimer, the term of this patent is extended or adjusted under 35 U.S.C. 154(b) by 0 days.

(21) Appl. No.: 13/470,826

(22) Filed: May 14, 2012

(51) Int. Cl.
*E04C 1/00* (2006.01)
*E04C 3/00* (2006.01)

(52) U.S. Cl.
USPC ..... 52/847; 52/309.4; 52/309.13; 52/836

(58) Field of Classification Search
USPC ..... 52/834, 836, 841, 843, 847, 309.4, 52/309.13, DIG. 8
See application file for complete search history.

(56) References Cited

U.S. PATENT DOCUMENTS

| | | | | | |
|---|---|---|---|---|---|
| 1,075,845 | A | * | 10/1913 | Mills | 52/843 |
| 3,716,179 | A | * | 2/1973 | Frydenberg et al. | 227/48 |
| 3,949,529 | A | | 4/1976 | Porter | |
| 3,999,343 | A | * | 12/1976 | Roberts | 52/241 |
| 4,224,774 | A | * | 9/1980 | Petersen | 52/404.1 |
| 4,442,649 | A | * | 4/1984 | Birckhead et al. | 52/693 |
| 4,501,102 | A | * | 2/1985 | Knowles | 52/690 |
| 4,615,162 | A | | 10/1986 | Evans | |
| 4,653,242 | A | * | 3/1987 | Ezard | 14/75 |
| 4,658,557 | A | * | 4/1987 | Mulford | 52/407.1 |
| 4,937,122 | A | * | 6/1990 | Talbert | 428/68 |
| 5,116,179 | A | * | 5/1992 | Matlock | 411/466 |
| 5,609,006 | A | | 3/1997 | Boyer | |
| 5,678,381 | A | * | 10/1997 | DenAdel | 52/836 |
| 5,713,176 | A | * | 2/1998 | Hunt | 52/847 |
| 5,867,963 | A | * | 2/1999 | Hershey | 52/650.2 |
| 5,992,125 | A | * | 11/1999 | Hardy | 14/75 |
| 6,125,608 | A | * | 10/2000 | Charlson | 52/847 |
| 6,244,016 | B1 | * | 6/2001 | Wolf | 52/790.1 |
| 6,318,046 | B1 | * | 11/2001 | Horsfield et al. | 52/847 |
| 7,905,073 | B2 | | 3/2011 | Brandes | |
| 2006/0156677 | A1 | * | 7/2006 | Benton | 52/693 |
| 2007/0227095 | A1 | * | 10/2007 | Hubbe | 52/653.1 |
| 2010/0236172 | A1 | * | 9/2010 | Wirth | 52/309.4 |
| 2011/0005163 | A1 | * | 1/2011 | Timmerman et al. | 52/653.1 |
| 2011/0239573 | A1 | * | 10/2011 | Lockhart | 52/404.1 |
| 2012/0011793 | A1 | * | 1/2012 | Clark et al. | 52/309.4 |

* cited by examiner

*Primary Examiner* — Joshua J Michener
*Assistant Examiner* — Ryan Kwiecinski
(74) *Attorney, Agent, or Firm* — Michael S. Neustel

(57) ABSTRACT

An insulated wall stud for reducing the energy loss via a wall stud. The insulated wall stud generally includes a first board, a second board, a plurality of brackets attaching the first board to the second board defining a space between thereof, and insulation material positioned between the boards within the space. The insulation material increases the thermal resistance of the wall stud.

18 Claims, 6 Drawing Sheets

INSULATED WALL STUD SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a wall studs and more specifically it relates to an insulated wall stud system for reducing the energy loss via a wall stud.

2. Description of the Related Art

Any discussion of the related art throughout the specification should in no way be considered as an admission that such related art is widely known or forms part of common general knowledge in the field.

Conventional wall studs are comprised of solid wood (e.g. a 2"×4" or 2"×6"). Unfortunately, conventional wall studs have a relatively low thermal resistance (i.e. relatively low R-value) and are the source of a significant amount of energy loss through a wall in a building structure thereby increasing the energy consumption of the building structure.

Because of the inherent problems with the related art, there is a need for a new and improved insulated wall stud system for reducing the energy loss via a wall stud.

BRIEF SUMMARY OF THE INVENTION

The invention generally relates to a wall stud which includes a first board, a second board, a plurality of brackets attaching the first board to the second board defining a space between thereof, and insulation material positioned between the boards within the space.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
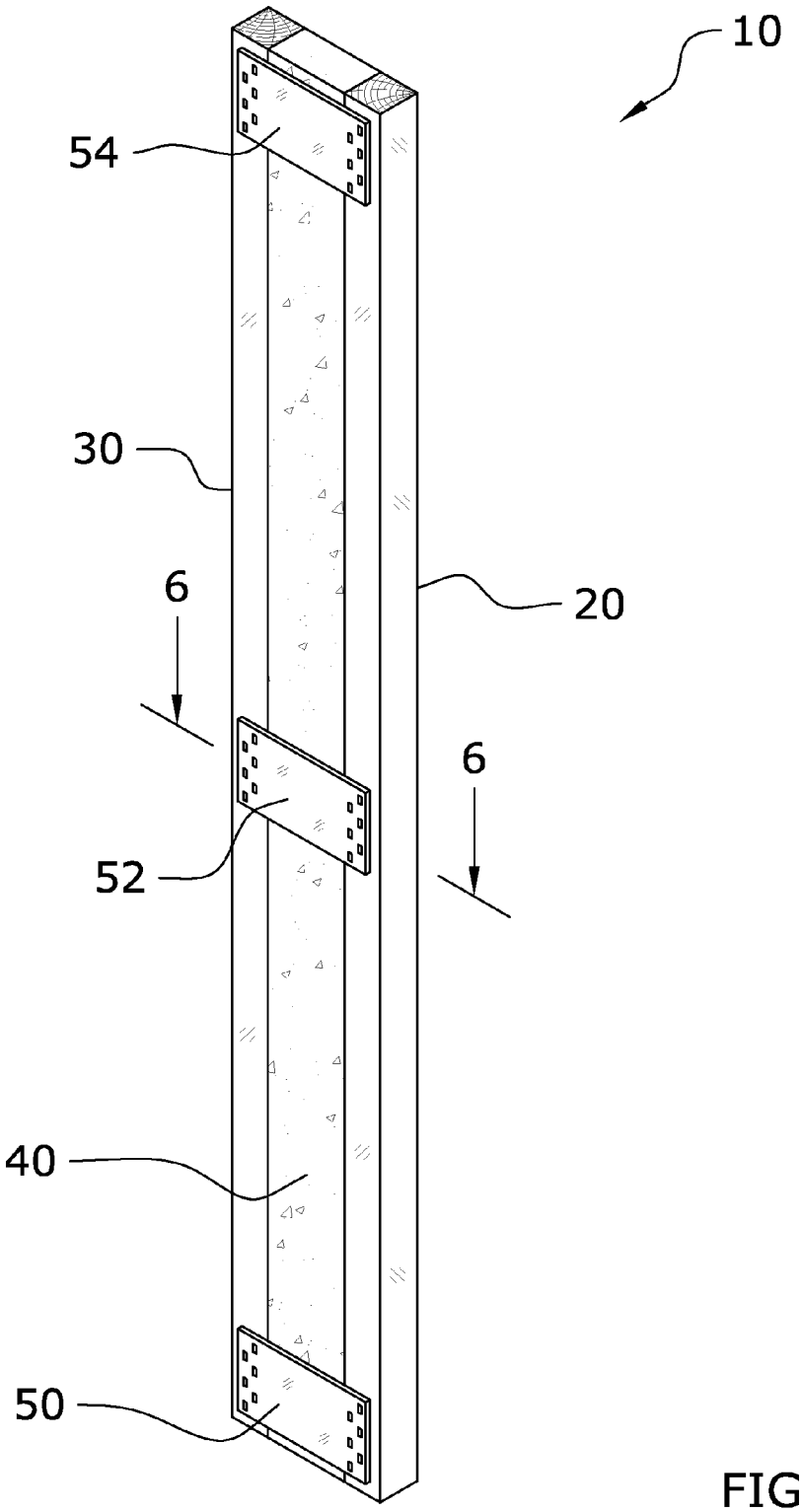
FIG. 1 is an upper perspective view of the present invention.
Figure 2:
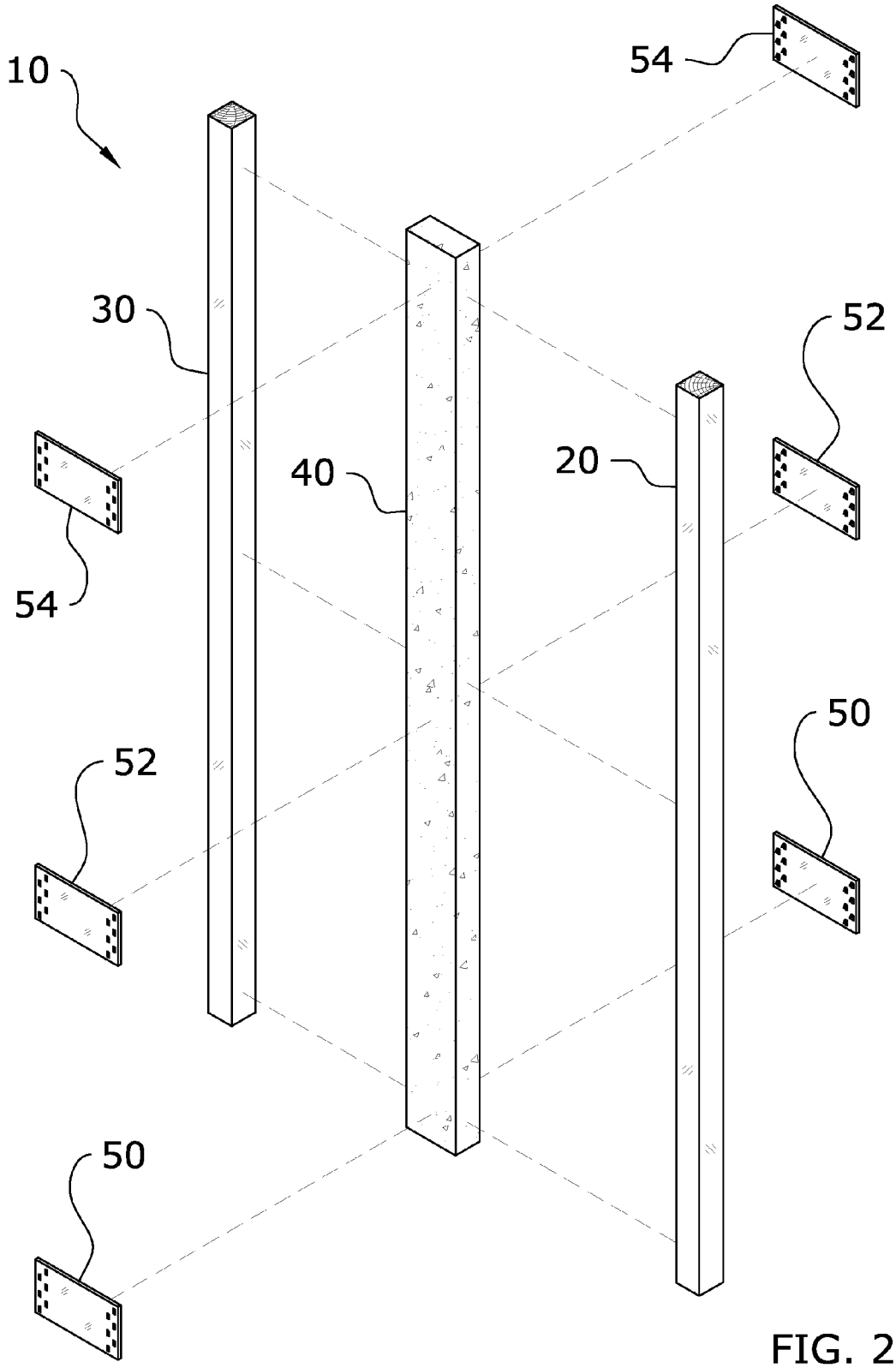
FIG. 2 is an exploded upper perspective view of the present invention.
Figure 3:
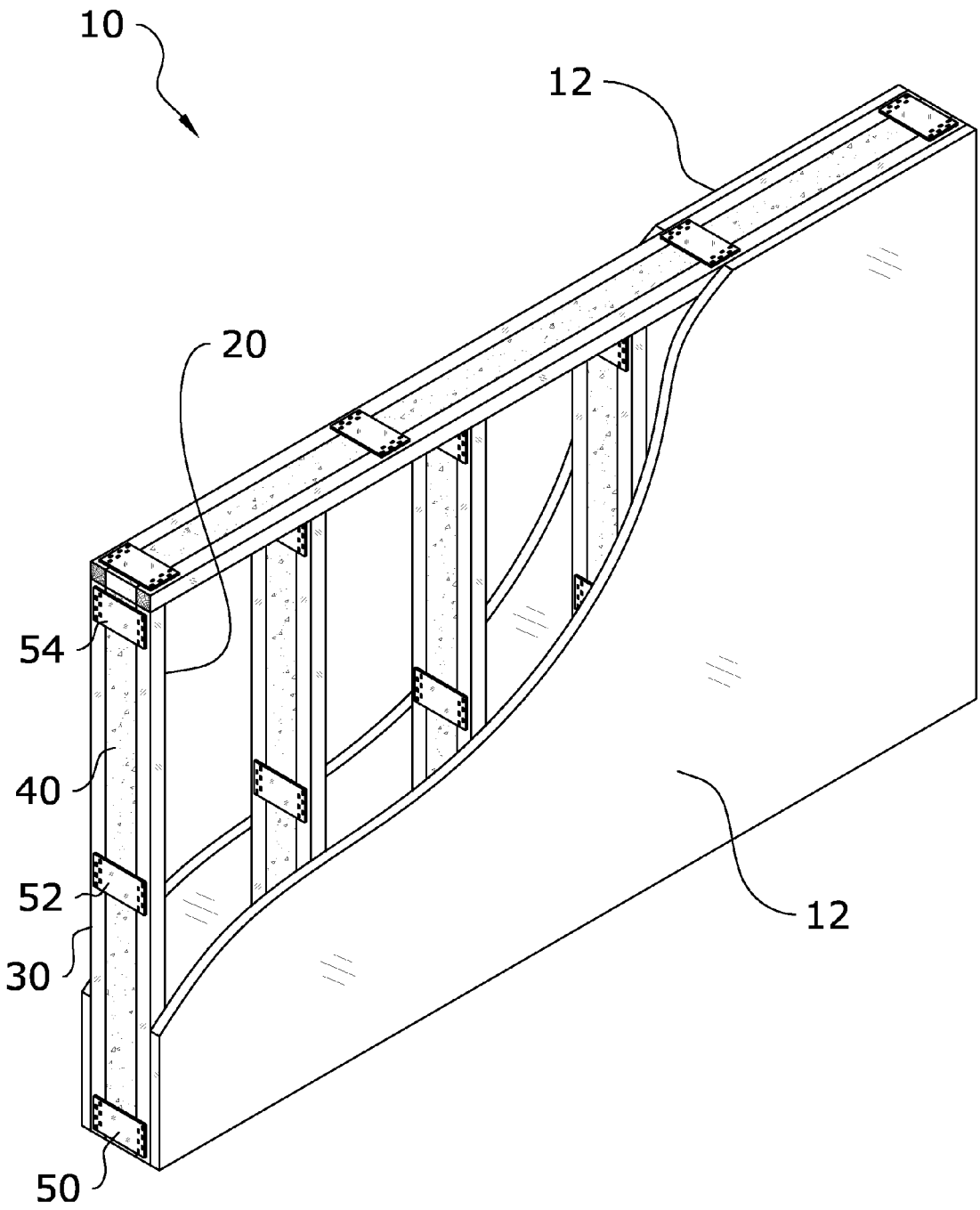
FIG. 3 is an upper perspective view of the present invention utilized to construct a wall structure with the sheet board partially cutaway.

Turning now descriptively to the drawings, in which similar reference characters denote similar elements throughout the several views, FIGS. 1 through 6 illustrate an insulated wall stud 10, which comprises a first board 20, a second board 30, a plurality of brackets 50, 52, 54 attaching the first board 20 to the second board 30 defining a space between thereof, and insulation material 40 positioned between the boards 20, 30 within the space. When fully assembled into the insulated wall stud 10, a plurality of the insulated wall studs may be secured together with conventional fasteners (e.g. nails, screws) to form a wall or similar structure with sheet board 12 (e.g. sheet rock, paneling, sheet board 12, etc.) attached to one or opposing sides thereof as shown in FIG. 3 of the drawings. While the term "wall stud" is used, it can be appreciated that the final insulated wall stud 10 may be utilized within various other parts of a building structure (e.g. floor, ceiling, rafters, etc.) or in non-building structures that require insulative properties.

B. First Board and Second Board.

FIGS. 1 through 4 and 6 illustrate the first board 20 and the second board 30 which are distally spaced apart from one another. When the boards 20, 30 are assembled together, the combination of the boards 20, 30 replicates the size and shape of a conventional wood stud used in a building structure. The assembled boards 20, 30 may have various lengths such as but not limited to 8 feet, 10 feet and the like. The first board 20 and the second board 30 preferably are comprised of the same length, width and thickness as illustrated in FIG. 2 of the drawings.

Figure 4:
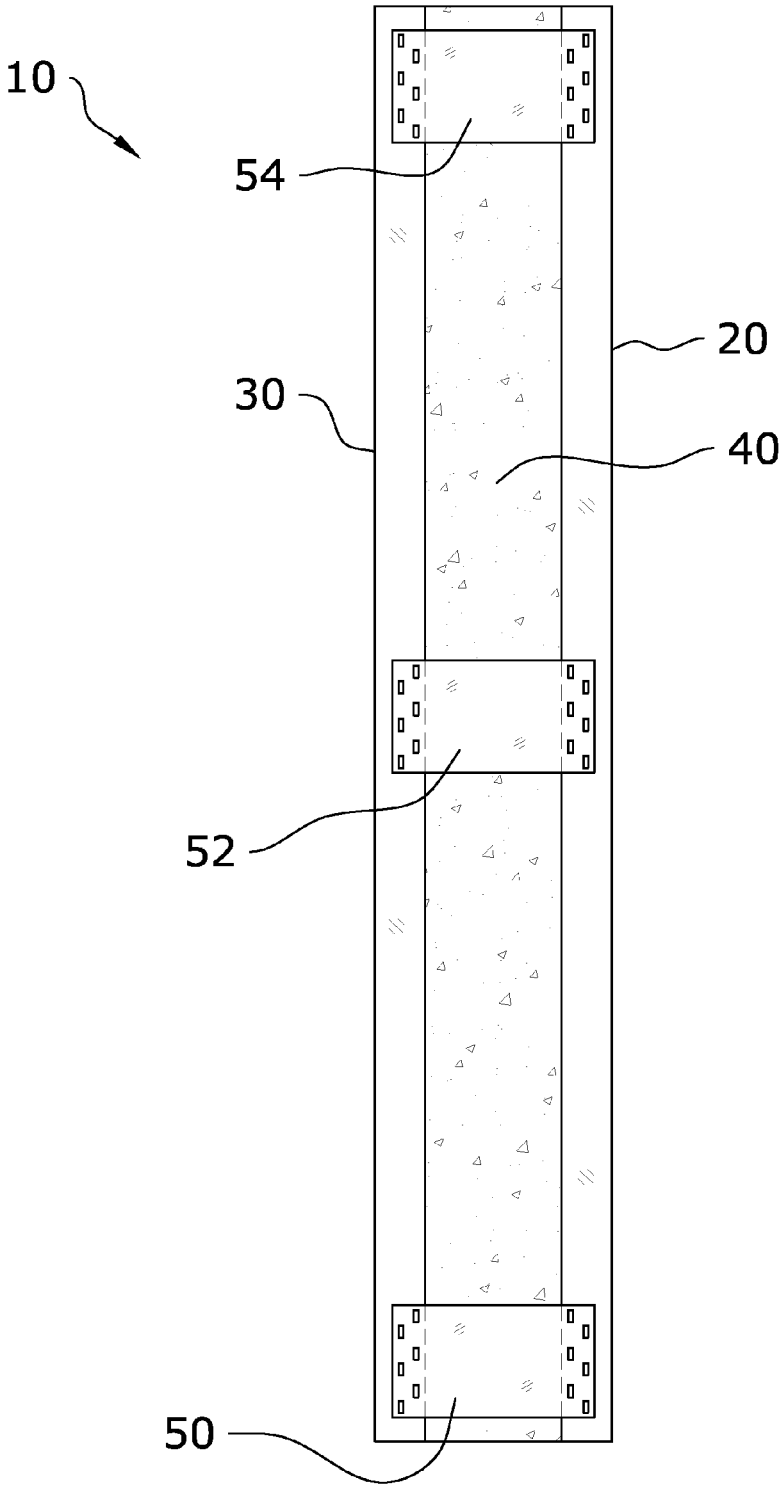
FIG. 4 is a side view of the present invention.

In particular, it is preferable that the distance between the outer edges of the boards 20, 30 be approximately the same as the width of a conventional wood stud when fully assembled as illustrated in FIGS. 1 and 4 of the drawings (e.g. the distance between the outer edges of a conventional 2"×4" or 2"×6"). For example, a conventional 2"×4" has a distance between the outer edges of approximately 3.5 inches, so the distance between the outer edges of the boards 20, 30 when assembled would also be approximately 3.5 inches when replicating a conventional 2"×4". As can be appreciated, the width for each of the boards 20, 30 is significantly less than the total width of the boards 20, 30 when assembled. The width of each of the boards 20, 30 is preferably optimal to provide for the required structural strength of the assembled insulated wall stud 10 while providing for the optimal amount of space between the boards 20, 30 to increase the amount of insulation material 40 able to be utilized thereby increasing the insulative properties of the insulated wall stud. The first board 20 and the second board 30 each preferably have a width and a thickness less than or equal to two inches.

Figure 5:
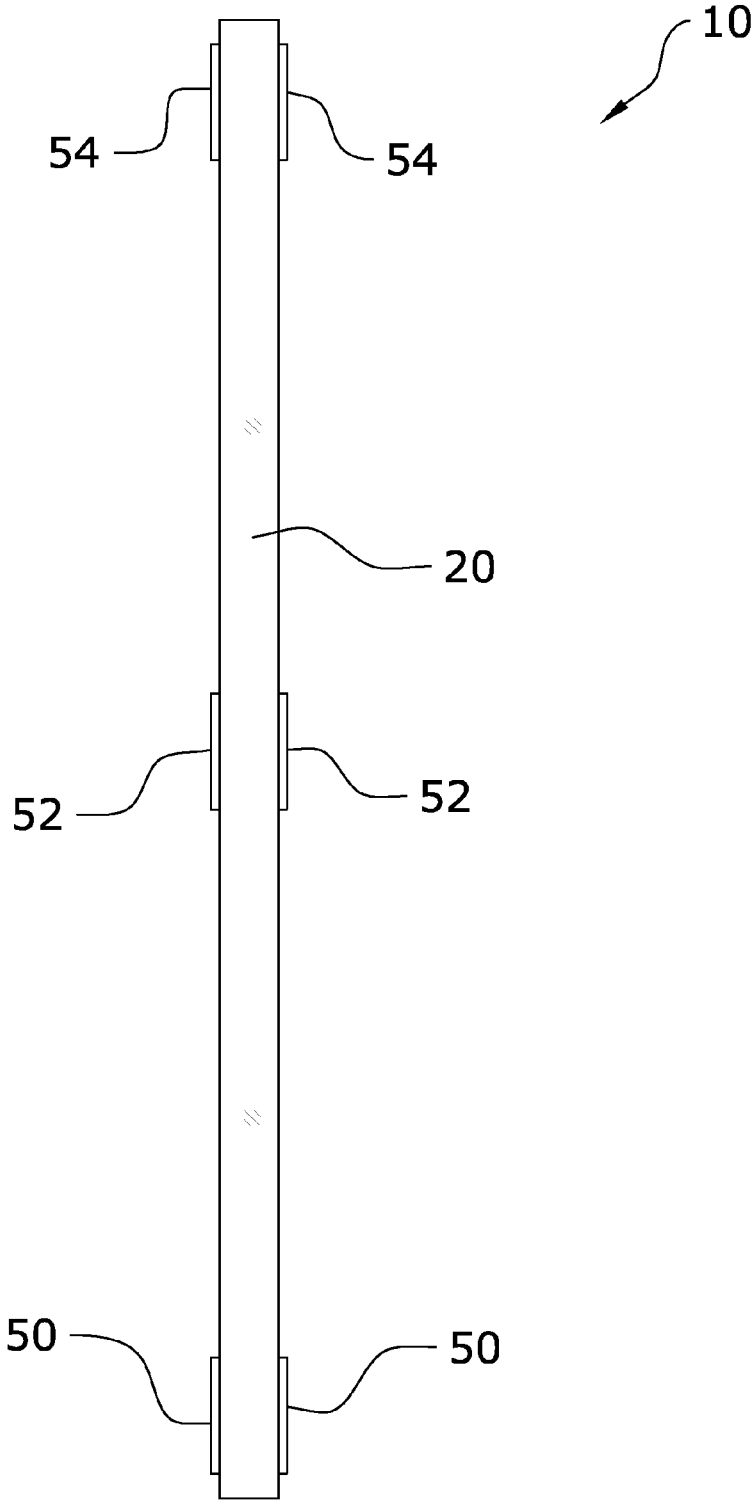
FIG. 5 is an end view of the present invention.

Also, it is preferable that the thickness of the boards 20, 30 be approximately the same as a conventional wood stud when fully assembled as illustrated in FIG. 5 of the drawings (e.g. the distance between each of the broad sides of a conventional 2"×4" or 2"×6"). For example, a conventional 2"×4" has a thickness of approximately 1.5 inches, so the thickness of the boards 20, 30 would also be approximately 1.5 inches when replicating a conventional 2"×4".

The first board 20 and the second board 30 are preferably each comprised of a material that may be cut with a conventional saw (e.g. hand saw, power saw) such as but not limited to wood or composite materials. The first board 20 and the second board 30 are parallel to one another when assembled into the insulated wall stud as shown in FIG. 4 of the drawings.

C. Brackets.

Figure 6:
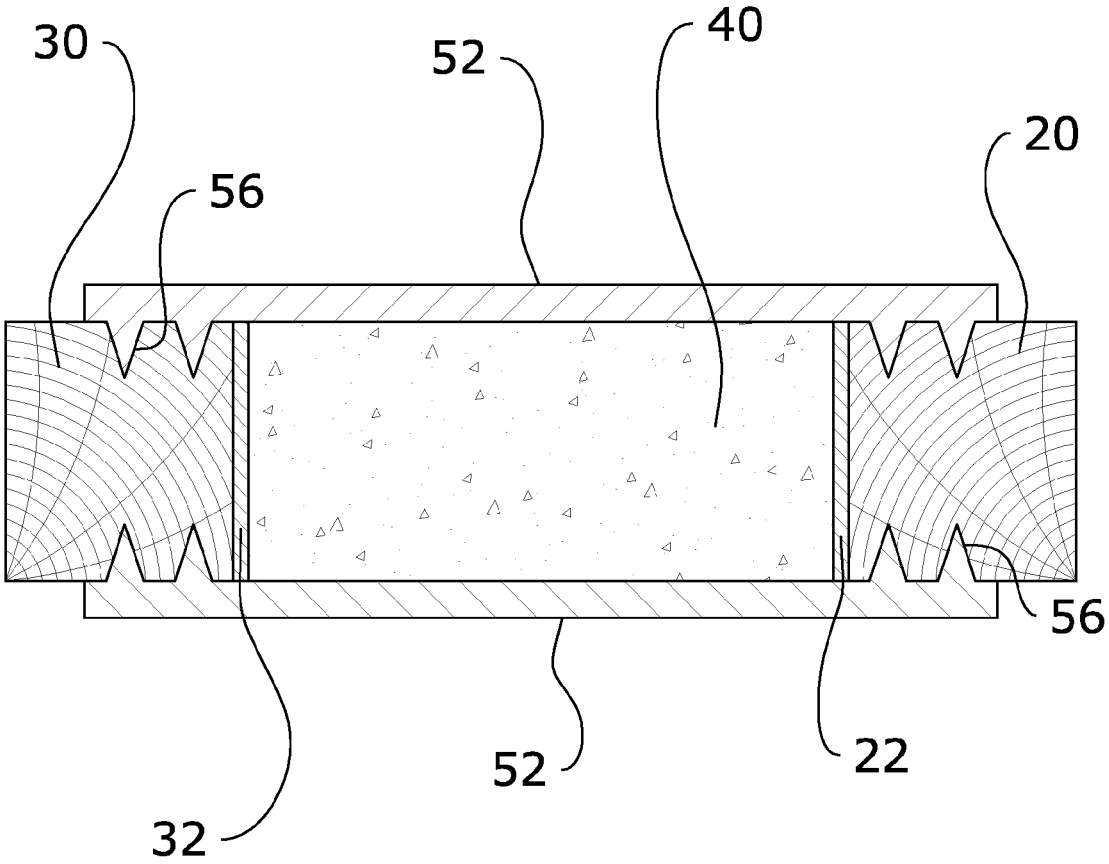
FIG. 6 is a cross sectional view taken along line 6-6 of FIG. 1.

FIGS. 1 through 6 illustrate the plurality of brackets 50, 52, 54 that attach the first board 20 to the second board 30 defining an insulation space between thereof. The plurality of brackets 50, 52, 54 are preferably attached to the boards 20, 30 in pairs on opposing sides of the first board 20 and the second board 30 as illustrated in FIGS. 2 and 6 of the drawings. For a typical insulated wall stud 10, it is preferable to have a pair of first brackets 50 attached to opposing sides of the boards 20, 30 near the lower end of the boards 20, 30, a pair of second brackets 52 attached to opposing sides of the boards 20, 30 in a central location of the boards 20, 30, and a pair of third brackets 54 attached to opposing sides of the boards 20, 30 near an upper end of the boards 20, 30. As can be appreciated, additional pairs of brackets 50, 52, 54 may be attached to the boards 20, 30 to provide for additional attachment. Furthermore, the brackets 50, 52, 54 do not have to be attached in pairs on opposing sides of the boards 20, 30 and instead may be staggered from side to side to the boards 20, 30.

As illustrated in FIGS. 1 and 4 of the drawings, it is preferable that the width of the brackets 50, 52, 54 be less than the width of the assembled insulated wall stud 10 to help reduce the energy loss through the brackets 50, 52, 54. In particular, if the brackets 50, 52, 54 are comprised of metal (e.g. steel), the brackets 50, 52, 54 will have a lower thermal conductivity (lower R-value) compared to the boards 20, 30 if the boards 20, 30 are comprised of wood. It is preferable that the distal ends of the brackets 50, 52, 54 be positioned at least 0.15 inches away from the outer edges of the boards 20, 30 to provide for spacing from the brackets 50, 52, 54 and any material attached to the inside/outside of the wall structure (e.g. sheet board 12). The more distance away from the outer edges of the boards 20, 30 the less energy loss via the brackets 50, 52, 54 by increasing the spacing between the brackets 50, 52, 54 and the sheet board 12 attached to the inside and outside of the wall structure.

The brackets 50, 52, 54 may be comprised of various types of materials such as metal, wood, composite and the like. The brackets 50, 52, 54 may be attached to the boards 20, 30 with various types of conventional fasteners such as but not limited to nails and screws.

The plurality of brackets 50, 52, 54 are preferably comprised of flat metal brackets 50, 52, 54 because of their strength and to prevent unnecessary extension within the wall structure. The flat metal brackets 50, 52, 54 preferably have a rectangular structure. It is preferable that the plurality of brackets 50, 52, 54 are comprised of mending plates each having a plurality of spikes 56 extending outwardly and into the first board 20 and the second board 30 to help increase the manufacturing efficiency of the final insulated wall stud and to retain a low profile for the brackets 50, 52, 54.

D. Insulation Material.

The insulation material 40 is positioned within the space between the first board 20 and the second board 30 as illustrated in FIGS. 1 through 4, and 6 of the drawings. The insulation material 40 is comprised of a material having a relatively low thermal conductivity (i.e. low R-value). The insulation material 40 may be comprised of various types of insulation such as but not limited to air, fiberglass or foam.

The insulation material 40 is preferably comprised of a foam insulation sheet (a.k.a. sheet foam) to provide increased insulation and additional strength to the overall insulated wall stud 10 when constructed. The foam insulation sheet is preferably substantially rigid in structure for increased strength. The insulation material 40 may be comprised of various types of foam insulation sheet materials such as but not limited to molded expanded polystyrene (MEPS), polyurethane or extruded expanded polystyrene (XEPS). The foam insulation sheet has a thickness approximately the same as the first board 20 and the second board 30 (e.g. 1.5 inches).

E. Adhesive.

A first adhesive 22 is preferably positioned between and attaching adjacent edges of the first board 20 and the insulation material 40 as illustrated in FIG. 6 of the drawings. As further shown in FIG. 6 of the drawings, a second adhesive 32 is preferably positioned between and attaching adjacent edges of the second board 30 and the insulation material 40. The adhesive used may be comprised of various materials capable of securing the insulation material 40 to the boards 20, 30. The adhesive is further applied along substantially the entire length of the boards 20, 30 and the insulation material 40.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An insulated wall stud, comprising:

a first board having a first outer edge and a first inner edge;

a second board having a second outer edge and a second inner edge, wherein said second outer edge faces away from said first board, wherein said first outer edge faces away from said second board and wherein said first inner edge faces said second inner edge;

a plurality of brackets attaching the first board to said second board defining a space therebetween;

wherein said plurality of brackets are each comprised of a rectangular structure having a first distal end and a second distal end;

wherein said first distal end and said second distal end are elongated and parallel with respect to said first outer edge and said second outer edge respectively;

wherein said first distal end and said second distal end of said plurality of brackets are positioned away from said first outer edge of said first board and said second outer edge of said second board respectively by at least 0.15 inches to decrease the energy loss via said plurality of brackets;

wherein said first distal end and said second distal end of said plurality of brackets are closer to said first outer edge of said first board and said second outer edge of said second board than to said first inner edge and said second inner edge; and a foam insulation material positioned within said space between said first board and said second board.

2. The insulated wall stud of claim 1, wherein said first board and said second board are each comprised of wood.

3. The insulated wall stud of claim 1, wherein said first board and said second board are parallel to one another.

4. The insulated wall stud of claim 1, wherein said first board and said second board each have a width and a thickness less than or equal to two inches.

5. The insulated wall stud of claim 1, wherein said plurality of brackets are attached in pairs on opposing sides of said first board and said second board.

6. The insulated wall stud of claim 1, wherein said plurality of brackets are comprised of flat metal brackets.

7. The insulated wall stud of claim 6, wherein said flat metal brackets each include a plurality of spikes extending outwardly and into said first board and said second board.

8. The insulated wall stud of claim 1, wherein said plurality of brackets are comprised of mending plates.

9. The insulated wall stud of claim 1, wherein said foam insulation material is comprised of a foam insulation sheet, wherein said foam insulation sheet has a thickness approximately the same as said first board and said second board.

10. An insulated wall stud, comprising:

a first board having a first outer edge and a first inner edge;

a second board having a second outer edge and a second inner edge, wherein said second outer edge faces away from said first board, wherein said first outer edge faces away from said second board and wherein said first inner edge faces said second inner edge;

a plurality of brackets attaching the first board to said second board defining a space therebetween;

wherein said plurality of brackets are each comprised of a rectangular structure having a first distal end and a second distal end;

wherein said first distal end and said second distal end are elongated and parallel with respect to said first outer edge and said second outer edge respectively;

wherein said first distal end and said second distal end of said plurality of brackets are positioned away from said first outer edge of said first board and said second outer edge of said second board respectively by at least 0.15 inches to decrease the energy loss via said plurality of brackets;

wherein said first distal end and said second distal end of said plurality of brackets are closer to said first outer edge of said first board and said second outer edge of said second board than to said first inner edge and said second inner edge;

a foam insulation material positioned within said space between said first board and said second board;

a first adhesive positioned between and attaching adjacent edges of said first board and said insulation material; and a second adhesive positioned between and attaching adjacent edges of said second board and said insulation material.

11. The insulated wall stud of claim 10, wherein said first board and said second board are each comprised of wood.

12. The insulated wall stud of claim 10, wherein said first board and said second board are parallel to one another.

13. The insulated wall stud of claim 10, wherein said first board and said second board each have a width and a thickness less than or equal to two inches.

14. The insulated wall stud of claim 10, wherein said plurality of brackets are attached in pairs on opposing sides of said first board and said second board.

15. The insulated wall stud of claim 10, wherein said plurality of brackets are comprised of flat metal brackets, wherein said flat metal brackets each include a plurality of spikes extending outwardly and into said first board and said second board.

16. The insulated wall stud of claim 10, wherein said plurality of brackets are comprised of mending plates.

17. The insulated wall stud of claim 10, wherein said foam insulation material is comprised of a foam insulation sheet.

18. An insulated wall stud, comprising:

a first board having a first outer edge and a first inner edge and a second board having a second outer edge and a second inner edge, wherein said second outer edge faces away from said first board, wherein said first outer edge faces away from said second board and wherein said first inner edge faces said second inner edge, wherein said first board and said second board are each comprised of wood, wherein said first board and said second board are parallel to one another, wherein said first board and said second board each have a width and a thickness less than or equal to two inches;

a plurality of brackets attaching the first board to said second board defining a space therebetween, wherein said plurality of brackets are attached in pairs on opposing sides of said first board and said second board, wherein said plurality of brackets are comprised of flat metal brackets, wherein said plurality of brackets are comprised of mending plates having a plurality of spikes extending outwardly and into said first board and said second board;

wherein said plurality of brackets are each comprised of a rectangular structure having a first distal end and a second distal end;

wherein said first distal end and said second distal end are elongated and parallel with respect to said first outer edge and said second outer edge respectively;

wherein said first distal end and said second distal end of said plurality of brackets are positioned away from said first outer edge of said first board and said second outer edge of said second board respectively by at least 0.15 inches to decrease the energy loss via said plurality of brackets;

wherein said first distal end and said second distal end of said plurality of brackets are closer to said first outer edge of said first board and said second outer edge of said second board than to said first inner edge and said second inner edge;

an insulation material positioned within said space between said first board and said second board, wherein said insulation material is comprised of a foam insulation sheet, wherein said foam insulation sheet has a thickness approximately the same as said first board and said second board;

a first adhesive positioned between and attaching adjacent edges of said first board and said insulation material; and a second adhesive positioned between and attaching adjacent edges of said second board and said insulation material.

* * * * *